US005777273A

United States Patent [19]

Woody et al.

[11] Patent Number: 5,777,273

[45] Date of Patent: Jul. 7, 1998

[54] HIGH FREQUENCY POWER AND COMMUNICATIONS CABLE

[75] Inventors: George R. Woody, Redondo Beach; Scott D. Downer, Torrance, both of Calif.

[73] Assignee: Delco Electronics Corp., Kokomo, Ind.

[21] Appl. No.: 686,808

[22] Filed: Jul. 26, 1996

[51] Int. Cl.[6] ..... H01B 11/02

[52] U.S. Cl. ..... 174/113 R; 174/116

[58] Field of Search ..... 174/113 R, 103, 174/36, 116, 106 R

[56] References Cited

U.S. PATENT DOCUMENTS

| | | | |
|---|---|---|---|
| 3,584,139 | 6/1971 | Swanson | 174/103 |
| 3,676,576 | 7/1972 | Dubernet et al. | 174/113 R |
| 3,857,996 | 12/1974 | Hansen et al. | 174/113 R |
| 4,510,468 | 4/1985 | Mayer | 333/12 X |
| 4,538,022 | 8/1985 | Barnicol-Ottler et al. | 174/113 R |
| 4,549,042 | 10/1985 | Akiba et al. | 174/114 R X |
| 4,675,474 | 6/1987 | Neuroth | 174/102 R X |
| 5,414,211 | 5/1995 | Chan | 174/36 |
| 5,521,333 | 5/1996 | Kobayashi et al. | 174/113 R |

*Primary Examiner*—Kristine L. Kincaid
*Assistant Examiner*—Chau N. Nguyen
*Attorney, Agent, or Firm*—Mark A. Navarre

[57] ABSTRACT

An electrical cable for use in high-frequency, high power applications, such as with an inductive charging system used to charge batteries of an electric vehicle. The cable has multiple twisted-pairs of separately insulated stranded wire arranged in a pseudo-Litz wire architecture that surround a coaxial cable. The coaxial cable carries bidirectional RF communication signals between a power source of the charging system and the vehicle. The cable has an outer EMI shield that includes a metalized mylar layer surrounded by a high coverage tinned-copper braid layer. The multiple twisted-pairs of wires and coaxial cable are embedded in a polytetrafluoroethylene filler material that surrounds them inside the outer EMI shield. An outer silicone cover is disposed around the outside of the cable. The cable efficiently transfers power at high-frequency AC power, between 100 KHz to 400 KHz at high-voltage levels, on the order of from 230 V to 430 V. The cable carries bidirectional RF communication signals using a 91.5 MHz carrier frequency. The cable is designed for use in an outdoor operating environment while maintaining its flexibility. The cable also has sufficient shielding to maintain EMI compatibility with other consumer products.

12 Claims, 1 Drawing Sheet

HIGH FREQUENCY POWER AND COMMUNICATIONS CABLE

BACKGROUND

The present invention relates generally to electrical cables, and more particularly, to a high frequency, high voltage power cable for use with an inductive charger system that charges electric vehicles.

The assignee of the present invention designs and manufactures inductive charging systems for use in charging electric vehicles. The charging system employs a charge port into which an inductive coupler is inserted to charge the electric vehicle. The inductive coupler is coupled to a power source by way of a cable.

The cable must be capable of handling high-frequency (100 KHz to 400 KHz) and high-voltage (230 V to 430 V), and carry bidirectional communication signals. The cable must also survive a rugged operating environment while maintaining its flexibility. The cable must also have sufficient shielding to maintain EMI compatibility with other consumer products. There are no known electrical cables that meet these requirements.

Standard commercially available cables that were investigated do not meet UL, FCC, communication link, flexibility, electrical, and thermal requirements. A number of commercially available cables were tested but their capacitance values were too high between the conductors and the outer shield. The outer shields also did not have enough coverage to provide EMI for shielding. The commercially available cables were too stiff to be used with a retraction mechanism. None of the commercially available cables had the power carrying capability in addition to a coaxial line for communication.

Accordingly, it is an objective of the present invention to provide for a high frequency power cable for use with an inductive charger system that charges electric vehicles. It is a further objective of the present invention to provide a high frequency power cable that handles high-frequency and high-voltage, carries bidirectional communication signals, is able to survive a rugged operating environment while maintaining flexibility, and have sufficient shielding to meet consumer EMI compatibility requirements.

SUMMARY OF THE INVENTION

To meet the above and other objectives, the present invention is an electrical cable designed for use with an inductive charging system that is used in electric vehicle charging applications. The cable is designed to efficiently transfer power at high-frequency AC power, between 100 KHz to 400 KHz at high-voltage levels, on the order of from 230 V to 430 V. The cable is designed to carry bidirectional RF communication signals between a power source of the charging system and the electric vehicle using a 915 MHz carrier frequency. The cable is rugged enough to survive an outdoor operating environment while maintaining its flexibility. The cable is also designed to have sufficient shielding to maintain EMI compatibility with other consumer products.

The electrical cable comprises multiple twisted-pairs of separately insulated stranded wire arranged in a pseudo-Litz wire architecture that surround a coaxial cable. The coaxial cable carries the bidirectional RF communication signals between a power source 13 of the charging system and the vehicle. The cable has an outer EMI shield that is comprised of a metallized MYLAR layer surrounded by a high coverage tinned-copper braid layer. The multiple twisted-pair of wires and coaxial cable are embedded in polytetrafluoroethylene (PTFE) filler material inside the outer EMI shield. An outer cover made of polyurethane or similar material is disposed around the outside of the cable.

The cable is used to carry power from the inductive charging system to the electric vehicle to charge it. The design of the cable allows transfer of high frequency AC power while passing stringent FCC radiated noise requirements. There were no commercially available cables that met this requirement. Initial experiments were performed with various coaxial cable designs, various twisted pair combinations, and various materials, with no breakthroughs. The final cable design that is the subject of the present disclosure meets UL, FCC, thermal, electrical, and flexibility requirements.

The cable was specifically developed for use as part of a 6.6 kilowatt inductive charging system developed by the assignee of the present invention. The cable is also designed for use as an output power cable for the 6.6 kilowatt charge port of the inductive charging system.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
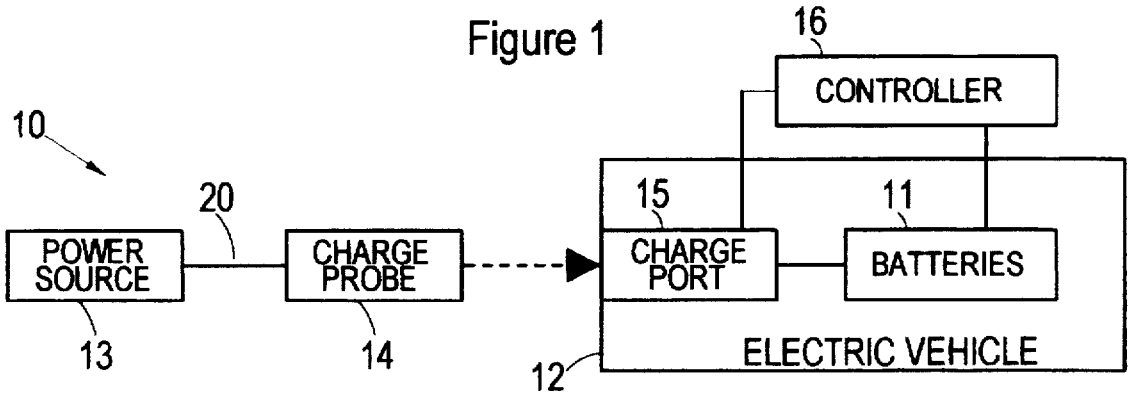
FIG. 1 illustrates an inductive charging system employing a high frequency, high voltage power cable in accordance with the principles of the present invention that is used to charge propulsion batteries of an electric vehicle.

Referring to the drawing figures, FIG. 1 is a block diagram that illustrates an inductive charging system 10 employing a high frequency, high voltage power cable 20 in accordance with the principles of the present invention that is used to charge propulsion batteries 11 of an electric vehicle 12. The inductive charging system 10 is comprised of a power source 13 that is coupled by way of the power cable 20 to a charge probe 14. The charge probe 14 is designed to be inserted into a charge port 15 located in the electric vehicle 12 (indicated by the dashed arrow). The charge probe 14 forms a primary of a transformer while the charge port 15 forms the secondary thereof. Once the charge probe 14 is inserted into the charge port 15, power is transferred from the power source 13 to the propulsion batteries 11 of the electric vehicle 12. Power is transferred from the power source 13 under control of a controller 16.

Figure 2:
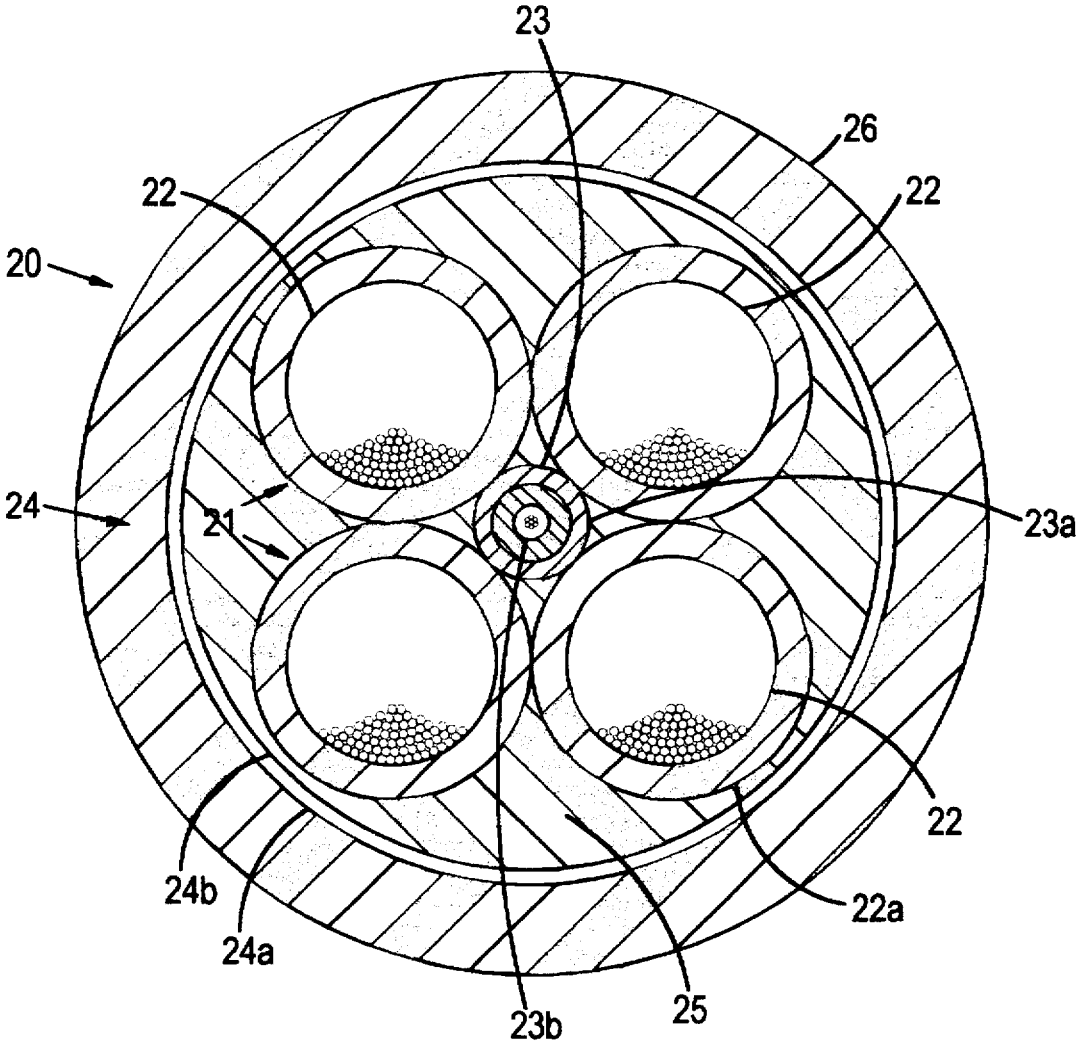
FIG. 2 illustrates a cross sectional view of the power cable in accordance with the principles of the present invention.

FIG. 2 is a cross sectional diagram of the high frequency, high voltage power cable 20 in accordance with the principles of the present invention. The power cable 20 may be preferably used as part of the inductive charging system that inductively charges the propulsion batteries 11 of the electric vehicle 12. However, it is to be understood that the present power cable 20 may be used in other applications where high frequency power and communication signals need to be transferred. As such, the present description should not be taken as limiting the scope of the present invention.

The power cable 20 comprises multiple twisted-pairs 21 of separately insulated stranded wire 22 arranged in a pseudo-Litz wire architecture. Each of the stranded wires 22 has an outer silicone jacket 22a disposed therearound. In an embodiment of the power cable 20 that was reduced to practice and shown in FIG. 2, two twisted-pairs 21 of stranded wire 22 were used and 12 AWG stranded wire 22 was used. In the reduced to practice embodiment of the power cable 20, conductors of each twisted pair 21 of wires 22 comprise 665 strands of fourty gauge wire to provide for flexibility. Coarser strands of 65 strands of thirty-six gauge wire may be used by increasing flexibility by using tubular type extrusion versus extrusion for the outer jacket 26

The multiple twisted-pairs 21 of stranded wire 22 surround a coaxial cable 23 that is used to carry bidirectional RF communication signals between the vehicle 12 and the power source 13 of the charging system 10. The coaxial cable 23 is similar to an RG178 coaxial cable, but uses a fine stranded center conductor 23b of 44 gauge wire to meet flexibility and durability requirements for use in a retraction mechanism (not shown) of the charging system 10. The center conductor 23b is surrounded by an insulator and encased in a silicone outer jacket 23a. The cable 20 has an outer EMI shield 24 that is comprised of high coverage tinned-copper braid 24a adjacent a layer 24b of metallized MYLAR. The multiple twisted-pair wires 21 and coaxial cable 23 are embedded in a polytetrafluoroethylene (PTFE) filler material 25 that surrounds them and which is surrounded by the metalized MYLAR layer 24b and tinned-copper braid 24a of EMI shield 24. An outer cover 26 that may be comprised of polyurethane, for example, is disposed around the outside of the cable 20.

The cable 20 was designed to efficiently transfer AC power at high-frequency, typically at 100 KHz to 400 KHz at high-voltage levels, on the order of from 230 V to 430 V. The cable 20 is designed to carry bidirectional communication signals using a 91.5 MHz carrier frequency. The cable 20 is ruggedly designed and is able to survive an outdoor operating environment while maintaining its flexibility. The outer EMI shield 24 of the cable 20 provides sufficient shielding to maintain EMI compatibility with other consumer products.

The capacitance between the multiple twisted-pairs 21 of stranded wire 22 and the outer EMI shield 24 is less than 85 picofarads per foot to reduce ringing. This was accomplished by using the polytetrafluoroethylene (PTFE) filler material 25 disposed between the multiple twisted-pairs 21 of stranded wire 22 and the outer EMI shield 24. The effectiveness of the outer EMI shield 24 was increased by wrapping a thin layer 24b of metalized MYLAR tape around the filler material 25 with its metalized surface facing the tinned-copper braid 24a of the EMI shield 24. The inductance of the cable 20 was also minimized by parallel twisting of the conductors to reduce series inductance.

Thus, a high frequency, high voltage power cable that may be used with an inductive charger system that charges electric vehicles has been disclosed. It is to be understood that the above-described embodiment is merely illustrative of some of the many specific embodiments which represent applications of the principles of the present invention. Clearly, numerous and varied other arrangements may be readily devised by those skilled in the art without departing from the scope of the invention.

The embodiments of the invention in which an exclusive property or privilege is claimed are defined as follows:

1. A high frequency power and communications cable comprising:

a coaxial cable for carrying bidirectional RF communication signals;

a plurality of separately insulated stranded wire power cables for carrying high frequency AC power, said stranded wire power cables being twisted around said coaxial cable to form a pseudo-Litz wire architecture;

an EMI shield surrounding said coaxial cable and said stranded wire power cables, said EMI shield comprising an inner layer of metalized MYLAR and an outer layer of tinned-copper braid;

polytetrafluoroethylene filler material disposed around the coaxial cable and stranded wire power cables within the EMI shield; and an outer cover surrounding said EMI shield.

2. The power and communications cable of claim 1 wherein each of the stranded wire power cables has an outer silicone jacket disposed therearound.

3. The power and communications cable of claim 1 wherein the plurality of stranded wire power cables comprise two pairs of stranded wire cables.

4. The power and communications cable of claim 1 wherein each of said stranded wire power cables comprises 665 strands of forty gauge wire.

5. The power and communications cable of claim 1 wherein the coaxial cable has an outer jacket and stranded center conductor.

6. The power and communications cable of claim 5 wherein the outer jacket of said coaxial cable comprises silicone.

7. A high frequency power and communications cable comprising:

a coaxial cable for carrying bidirectional RF communication signals;

four separately insulated stranded wire power cables for carrying high frequency AC power, said stranded wire power cables twisted around said coaxial cable to form a pseudo-Litz wire architecture;

an EMI shield surrounding said coaxial cable and said stranded wire power cables said EMI shield comprising an inner layer of metalized MYLAR surrounded by an outer layer of tinned-copper braid;

polytetrafluoroethylene filler material disposed around the coaxial cable and stranded wire power cables within the EMI shield; and an outer cover surrounding said EMI shield.

8. The power and communications cable of claim 7 wherein each of the stranded wire power cables has an outer silicone jacket disposed therearound.

9. The power and communications cable of claim 7 wherein each of said stranded wire power cables comprises 665 strands of forty gauge wire.

10. The power and communications cable of claim 1 wherein each of said stranded wire power cables comprises 65 strands of thirty-six gauge wire.

11. The power and communications cable of claim 7 wherein the coaxial cable has an outer jacket and stranded center conductor.

12. The power and communications cable of claim 11 wherein the outer jacket of the coaxial cable comprises silicone.

* * * * *